US010967490B2

(12) United States Patent
Paskvan

(10) Patent No.: US 10,967,490 B2
(45) Date of Patent: Apr. 6, 2021

(54) CONCRETE FORM STRIPPING TOOL

(71) Applicant: Gary Paskvan, Burlington, CT (US)

(72) Inventor: Gary Paskvan, Burlington, CT (US)

( * ) Notice: Subject to any disclaimer, the term of this patent is extended or adjusted under 35 U.S.C. 154(b) by 43 days.

(21) Appl. No.: 15/810,016

(22) Filed: Nov. 11, 2017

(65) Prior Publication Data

US 2018/0147705 A1 May 31, 2018

Related U.S. Application Data

(60) Provisional application No. 62/406,037, filed on Oct. 10, 2016.

(51) Int. Cl.

| | |
|---|---|
| ***B66F 3/00*** | (2006.01) |
| ***B25B 27/14*** | (2006.01) |
| ***E04G 9/04*** | (2006.01) |
| ***E04G 19/00*** | (2006.01) |
| ***E04G 11/08*** | (2006.01) |
| ***E04G 11/10*** | (2006.01) |
| ***E04G 17/04*** | (2006.01) |
| *E04G 9/02* | (2006.01) |

(52) U.S. Cl.

CPC ..... *B25B 27/14* (2013.01); *E04G 9/04* (2013.01); *E04G 11/087* (2013.01); *E04G 11/10* (2013.01); *E04G 17/045* (2013.01); *E04G 19/00* (2013.01); *E04G 2009/028* (2013.01)

(58) Field of Classification Search

CPC ..... B25B 27/14; E04G 9/04; E04G 19/00
USPC ..... 254/21, 25, 30, 131, 132
See application file for complete search history.

(56) References Cited

U.S. PATENT DOCUMENTS

| | | | | |
|---|---|---|---|---|
| 5,749,113 A * | 5/1998 | Witter | B25C 11/00 | 254/131 |
| 6,354,570 B1 * | 3/2002 | Christensen | B66F 15/00 | 254/131 |
| D498,129 S * | 11/2004 | Parker | B25C 11/00 | D8/89 |
| 6,913,246 B1 * | 7/2005 | Skach | B25C 11/00 | 254/131 |
| 7,618,020 B2 * | 11/2009 | Del Favero | B66F 15/00 | 254/131 |

(Continued)

*Primary Examiner* — Joseph J Hail
*Assistant Examiner* — Shantese L McDonald
(74) *Attorney, Agent, or Firm* — Handal & Morofsky; Anthony H. Handal

(57) ABSTRACT

A tool for removing, from a set concrete wall, a concrete form of a type having a discontinuous structure is provided. The tool comprises a lever arm, comprising an engagement portion and a grasping portion. The engagement portion is positioned near one end of the lever arm, and the grasping portion is positioned near an opposite end of the lever arm. An engagement member is secured to the engagement portion. The engagement member is configured to engage the discontinuous structure. A pivoting member is mounted on the lever arm proximate the engagement portion. The pivoting member defines a pivot point around which the lever arm may rotate, whereby the engagement member will apply force to the discontinuous structure tending to pull the concrete form away from the set concrete wall when the engagement portion of the lever arm is pulled away from the set concrete wall when the engagement member is in engagement with the discontinuous structure.

22 Claims, 17 Drawing Sheets

(56) References Cited

U.S. PATENT DOCUMENTS

| | | | | |
|---|---|---|---|---|
| 2004/0089856 | A1* | 5/2004 | Barto | B66F 15/00 254/131 |
| 2005/0120672 | A1* | 6/2005 | Gargiulo | B28B 13/06 52/749.1 |
| 2005/0120831 | A1* | 6/2005 | Parker | E04D 15/003 81/45 |

* cited by examiner

CONCRETE FORM STRIPPING TOOL

TECHNICAL FIELD

The present invention relates generally to construction tools. More specifically, this invention relates to tools for concrete foundation settings. Still more specifically, the present invention relates to tools for the removal of replaceable framework in concrete foundation pouring.

CROSS REFERENCE TO RELATED APPLICATIONS

This application claims the priority of U.S. Provisional Patent Application No. PTO 62/406,037 filed Oct. 10, 2016, entitled Concrete Form Stripping Tool, the disclosure, claims and drawings of which are hereby incorporated by reference.

STATEMENT REGARDING FEDERALLY SPONSORED RESEARCH OR DEVELOPMENT (Not applicable)

BACKGROUND OF THE INVENTION

In the setting of concrete for the foundation of an architectural structure, concrete forms are used to mold the surfaces of architectural components such as concrete walls being formed into structural, functional non-structural and/or aesthetic components of the building. Concrete forms generally comprise a wooden or metal framework which cooperates with typically replaceable plywood faces. For example, 4 foot by 8 foot sheets of three-quarter inch plywood are typically fitted to, and screwed or bolted to a sheet metal steel frame. In the commercial concrete foundation industry, walls are constructed by joining wooden or metal forms (for example Symons® forms, which are particularly suited to use with the present invention).

Generally, a number of forms are joined to each other to form an outer mold wall. Likewise, other forms are joined to each other to form an inner mold wall. Rebar or other reinforcement material or other structural or non-structural members may also be placed within the volume between the inner and outer networks of forms. The molding structure is completed by a number of structural elements that secure the inner and outer networks of forms to each other and maintain space between them to form a volume to receive concrete.

Concrete (for example a mixture of cement, sand, gravel, limestone and/or additives selected to harden the concrete to various environmental conditions such as salt water, problematic ground water or the like) is poured between the inner and outer networks of forms to form the concrete wall or other architectural member, with the inner and outer networks of forms forming, for example, in the case of an external wall, the inside and outside walls of a building.

The inner network of forms is such that the plywood faces of the forms essentially define the shape and position of the inside surface of a wall being constructed. Similarly, the outer network of forms is such that the plywood faces of the forms essentially define the outer surface of a wall being constructed. For example, if one is pouring a foundation wall, fluid concrete is poured within the spaces defined between the forms to produce the walls of the foundation. Once the concrete is set, the forms are extracted; however, there exists a need for a tool that functions with existing concrete forms to easily remove the forms from a poured concrete wall.

The panel system itself is multi-dimensional to conform to any wall length, comprising a plurality of form sections that are joined to each other to form a mold matching a desired wall dimension. Forms are also stackable to achieve various wall heights, for example, in the foundation and in the floors above the foundation. Typically, a first network of mold panels forms and defines a first surface matching the outer surface of the wall being constructed. A second network of mold panels form and define a second surface constructed in a position in facing spaced relationship to the first surface. The volume of the mold, into which cement is to be poured, and which corresponds to the wall being constructed, is defined between the first and second surfaces. The wall is constructed by pouring concrete between the first and second surfaces and allowing it to cure and harden, after which the plywood mold sections are removed and, in the interest of economy, where possible, reused.

After the cement has been poured and has had time to cure and harden, it is necessary to remove the inner and outer networks of forms from the finished wall. Currently, the standard way to remove a form section (corresponding to a single mold panel or form from which the inner and outer networks of forms were constructed) and separate it from a wall is to the use of various hand tools for applying leverage, pressure and impact. Typically this may be done after the volume between the inner and outer networks has been filled with concrete and cured for 1 to 3 days (or longer, depending upon the mix, construction details, temperature and other environmental factors, and other factors familiar to those of ordinary skill in the art, Typically, this may be done by the use a claw hammer and a wrecking or pry bar to pry the mold from the finish concrete wall by prying against the finished surface of the concrete wall. Sometimes a great deal of force must be used to separate the plywood face of the form from the surface of the concrete wall which may adhere to the form with a great deal of strength.

However, this operation can damage the plywood face which is meant to give the face of the wall a smooth concrete finish. When the face of the plywood that is against the poured concrete is damaged during the form removal process, in subsequent uses of the same mold, the finished concrete wall will be formed with and will show dents, gouges and other imperfections in the plywood because the poured concrete will conform to the gouges, dents and other imperfections in the form's surfaces when the concrete is in its fluid state. Thus, as the plywood component of a mold sections becomes increasingly damaged, it needs to be replaced. In order to replace the plywood, it is necessary to remove the plywood from the metal or wooden frame of the form. A replacement plywood panel then must be riveted in place. This is costly in material and labor. A need exists for technology that extends the life of the forms.

SUMMARY OF THE INVENTION

There have been attempts to address the issue of removal of concrete forms; see, for example, U.S. Pat. No. 6,817,590. In this system, a lever and a loose and separate cylindrical fulcrum are used to pry forms away from set cement. This is done with a claw which engages a specialized "knob" which protrudes from the concrete form. However, the device applies a twisting moment to the knob, damaging the mold section. In addition, such specialized molds may be more expensive than other molds and are thus associated with increased costs to manufacture. Moreover, such a device cannot function efficiently with existing form molds in the industry, such as Symonds™-type molds.

Likewise, because this technology requires a multiple part mold section removing tool, comprised of a lever and fulcrum, this makes operation difficult and perhaps requires two men to do the work of prying the forms from the walls.

The present invention overcomes these deficiencies in the prior invention by allowing use with other concrete forms, requiring no modification or adaptation to the forms; the addition of a functioning wheel portion which allows for easier extraction of set concrete forms, and minimizing wear and tear to the form sections. The system also provides for multiple engagement members to allow for a variety of orientations and angles to adapt the use of the tool to the orientation of the target forms in need of extraction. The engagement members are further angularly oriented in different directions to enable engagement of the holes on the concrete mold during use.

Because the engagement members are positioned at different points, they allow force to be applied in different directions and enable the tool to be used on plywood mold forms assembled in a variety of geometrical configurations, permitting different types of accessibility to the molds and the associated holes. The invention has a further advantage of linking up with existing slots or holes on molds. Those existing holes are intended for the attachment of one mold to another using a first pin with a large head passing through the sidewalls of two molds to be joined to each other, and a second pin for passing through the first pin to lock the two molds to each other.

The tool of the present disclosure further provides for a concrete form mold extracting tool capable of use by a single individual, specifically, a tool capable of functioning with existing form molds in widespread use in the concrete foundation industry while minimizing wear and tear to the mold.

According to an exemplary embodiment of the present disclosure, a tool for concrete form stripping is provided. The tool comprises a lever arm portion, a wheel portion, and an engagement portion. The lever arm portion provides a grasping end on the tool for the user and functions to provide leverage for the user of the tool in extraction of a concrete form. The wheel portion functions as a fulcrum and allows for the user to brace the tool against the solid concrete surfaces in order to more easily extract a set form mold. The engagement portion is capable of use with existing concrete form molds where the engagement member of the tool engages existing inserts in the wooden or metal frame of the form, for example the slots used to receive pins to join together Symons™ forms.

According to another exemplary embodiment of the present invention, an alternative embodiment of the invention comprises a tool for concrete form stripping. The tool comprises a lever arm portion, a wheel portion, and an engagement portion. Additionally, the engagement portion may be comprised of a singular or multiple engagement members arranged in a plurality of orientations to provide multiple angles of attack for the user of the tool. In this exemplary embodiment, the engagement members may be hooking members.

According to another exemplary embodiment of the present discloser, a further tool for concrete form snipping is provided. The tool comprises a lever arm portion, a wheel portion, and an engagement portion. Additionally, the engagement portion may be comprised of singular or multiple engagement members arranged in a plurality of orientations to provide multiple angles of approach for the user of the tool. In this exemplary embodiment, the engagement members may be grasping members. These and other features and attributes of the present disclosure and their advantageous applications and/or uses will be apparent from the detailed description which follows, particularly when read in conjunction with the figures appended hereto.

In accordance with the invention, a tool for removing, from a set concrete wall, a concrete form of a type having a discontinuous structure is provided. The tool comprises a lever arm, comprising an engagement portion and a grasping portion. The engagement portion is positioned near one end of the lever arm, and the grasping portion is positioned near an opposite end of the lever arm. An engagement member is secured to the engagement portion. The engagement member is configured to engage the discontinuous structure. A pivoting member is mounted on the lever arm proximate the engagement portion. The pivoting member defines a pivot point around which the lever arm may rotate, whereby the engagement member will apply force to the discontinuous structure tending to pull the concrete form away from the set concrete wall when the engagement portion of the lever arm is pulled away from the set concrete wall when the engagement member is in engagement with the discontinuous structure.

The pivoting member may comprise a pivot surface defined on a stud that is rigidly secured to the lever arm. Alternatively, the pivoting member may comprise a wheel rotatably mounted near the engagement portion of the lever arm.

The engagement member may comprise a stud extending from the engagement portion, with the stud having a base portion and an engagement end, the base portion of the stud being secured to the engagement portion of the engagement member, and the engagement end being configured to engage a hole or slot in the concrete form.

The lever arm has a bent portion proximate the engagement portion of the lever arm and the engagement member may be mounted within the acute portion of the angle formed by the bend.

The engagement portion of the lever arm, the base portion of the engagement member and the engagement end of the engagement member may generally define a U-shape.

The engagement portion of the lever arm is no larger than half the length of the remaining portion of the lever arm, or alternatively the engagement portion of the lever arm is smaller than one-third the length of the remaining portion of the lever arm.

Multiple engagement members may be provided at multiple orientations with respect to the lever arm. For example, a second engagement member secured to the lever arm at a position different from the position at which the engagement member is mounted, and the orientation of the engagement member with respect to the lever arm may be different from the orientation of the second engagement member with respect to the lever arm. Optionally, a second engagement member may be secured to the lever arm at a position different from the position at which the engagement member is mounted, and the orientation of the engagement member with respect to the lever arm may be different from the orientation of the second engagement member with respect to the lever arm. The engagement member is angularly oriented with respect to the lever arm. The angle is between 0° and 40°.

The engagement member is a hooking member, or a U-shaped engagement member, configured and dimensioned to slide under a knob on the concrete form, the U-shaped engagement member being rotatably mounted on the engagement portion of the lever arm.

The inventive method for removing, from a set concrete wall, a concrete form of a type having a discontinuous structure comprises pulling a lever arm away from the wall, after engaging an engagement member on an engagement portion of the lever arm, by pulling a grasping portion of the lever arm, where the engagement portion is positioned near one end of the lever arm, and the grasping portion is positioned near an opposite end of the lever arm. This is done by pivoting the lever arm about a pivoting member mounted on the lever arm proximate the engagement portion, the pivoting member defining a pivot point around which the lever arm rotates during the pulling and pivoting, whereby the engagement member applies force to the discontinuous structure tending to pull the concrete form away from the set concrete wall.

BRIEF DESCRIPTION OF THE DRAWINGS

The construction and operation of the inventive tool for concrete form extraction will become apparent from the following description taken in conjunction with the drawings, in which.

DETAILED DESCRIPTION OF THE PREFERRED EMBODIMENTS

Figure 1:
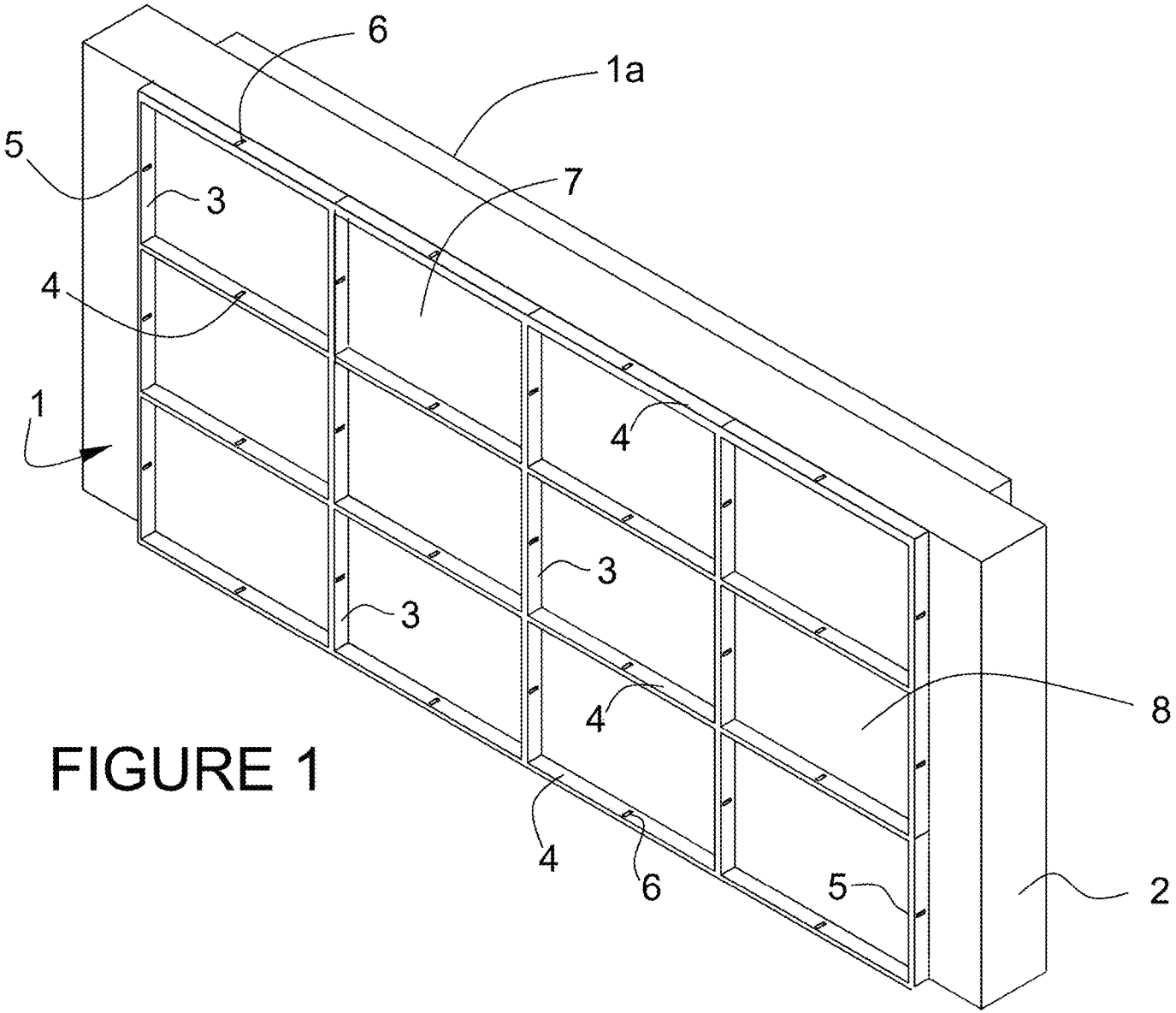
FIG. 1 is an exemplary non-limiting diagram detailing the relationship between a concrete wall formed from concrete forms and a mold section.

The present invention is directed to a tool for extraction of concrete forms from a formed, hardened and cured concrete wall. The inventive tool is distinguishable over the prior art in that it is capable of use with and/or adaptable to numerous types of existing concrete forms, in many cases without requiring modification or adaption to the forms.

The advantage of the inventive tool is derived, in part, from the use of a wheel in place of the fixed fulcrum of the prior art. This allows for easier extraction of concrete forms from set concrete walls. Ease-of-use is promoted by the provision of optional multiple engagement members which allow for a variety of orientations, directions of approach and angles of operation. In this manner, the use of the tool may be adapted to the orientation of the target forms in need of removal or extraction, as well as the nature of the wall sections and/or structural and other surroundings adjacent to the form to be removed.

The advantageous characteristics of the disclosed device, in addition to providing an easy to use design and the capability of use with existing concrete form molds, also provides for efficient use by a single individual user, insofar as there is no need to place a separate fulcrum. In addition, because the inventive tool uses a wheel dependent instead of a fixed fulcrum point, forces applied to the wall and the concrete form are minimized, allowing extraction with minimal if any damage to the plywood forms. This allows the forms to be re-used a greater number of times in further concrete pouring operations, and with minimal introduction of surface irregularities to the walls being formed.

The present invention may be used with existing concrete form designs. The panel system itself is multi-dimensional to conform to any wall length. The form sections come in many sizes thus allowing them to employed in construction conforming to a wide range of architectural specifications.

The individual form sections that are joined to each other via a plurality of wedge bolts, allowing them to be secured in networks of forms which provide a mold system matching a desired wall dimension. The wedge bolt may be held in position by another wedge bolt performing a locking function and passing through a hole in the wedge bolt performing the joining function in a manner known to those of ordinary skill in the art. The joining and locking wedge bolts are typically identical.

Forms are also stackable to achieve various wall heights. Typically, a first network of mold panels forms a first surface matching the outer surface of the wall being constructed. A second network of mold panels form a second surface constructed in facing spaced relationship to the first surface. The volume of the mold, which corresponds to the wall being constructed, is defined between the first and second surfaces. The wall is constructed by pouring concrete between the first and second surfaces and allowing it to cure and harden, after which the plywood mold sections are removed and, ideally, reused.

A variety of concrete forms exist in the market, many of which utilize insertion points for interlocking units. The tool of the present disclosure is capable of use with a variety of existing concrete forms. For example, the disclosed tool may be used with forms produced by Wall-Ties & Forms and Symons® forms, which both utilize the joining pin method of form unit connection. The tool may further be used in connection with Peri Forms, Ulma Evermax forms, Sym-Ply forms, Harris Ply System, and Nevi Forms. The disclosed tool may be designed to function with doka forms as well, which utilize a key hole shape in their concrete form units (see FIG. 19).

In an exemplary embodiment of the present disclosure, the inventive tool comprises a lever arm having a grasping end and an angularly displaced engagement end. The lever arm is provided with at least one, but preferably a plurality of, engagement members secured to various points at various locations in an engagement portion of the lever, wherein the engagement members are generally proximate to and/or at the engagement end of the lever arm. The engagement members are each configured, dimensioned and positioned to engage holes typically provided in existing known plywood mold members. The grasping end is configured as to allow for the user to grasp the tool to apply the appropriate leverage and force to reposition the targeted concrete form.

The tool further comprises a wheel against which the lever pivots and which, during use, rolls along and bears against, for example, a portion of a finished and substantially cured concrete surface. The wheel functions as a fulcrum providing leverage for the removal of the concrete form from its set position while additionally allowing the tool to glide on a hard surface, for example, the hardened concrete wall. During use, one of the engagement members is extended into and engages one of the holes on an existing concrete form in contact with the cured concrete surface, and which served as a model for forming the portion of the concrete surface which it is contacting. Next, using the wheel as a fulcrum, force may be applied to the grasping end of the lever to cause the engagement member to pry the concrete form from the cured concrete wall without damaging the wall. The prying operation is also without substantial friction resulting in a relatively small amount of force being needed for the lever to pry the mold from the concrete.

In an alternative exemplary embodiment of the present disclosure, the tool comprises a number of engagement members which may be used to engage the holes on the concrete forms used to cast the wall. In use, one or more of the engagement members are engaged with the hole on the form and the lever is pulled in a direction which results in the engagement member engaging the wall being pulled away from the cast wall, separating the form from the cast wall. The addition of a plurality of engagement members allows the user to easily manipulate the concrete form mold by providing a variety of orientations and angles for the user to engage the existing holes within the form.

FIG. 1 is an exemplary non-limiting diagram illustrating the relationship between a) a concrete wall, and b) a concrete form, which (together with other concrete forms) formed an inner and outer network of forms, which was filled with concrete to mold the wall. More particularly, the mold comprises an inner mold structure which is made from a network of interlocked concrete forms, such as form 1, and an outer mold structure which is also made from a network of interlocked concrete forms, such as form 1*a* (illustrated in phantom lines), located on the other side of the concrete wall 2 opposite the inner structure, which comprises in part form 1. The network of interlocked concrete forms 1 is fitted with one unit (or optionally more units) of plywood board 8. As is apparent from the illustration of FIG. 1, plywood board 8 is located on that side of the form facing toward the wall 2 to be formed. Accordingly, after formation of wall 2, plywood board 8 is in contact with the concrete wall 2.

Turning to the details of the construction of form 1, the form is divided into a number of sectors by vertical struts 3 and horizontal spanners 4. Both the vertical struts 3 and horizontal spanners 4 are provided with a number of elongated holes 5 and 6, respectively. Elongated holes or slots 5 and 6 allow additional wall portions to be molded horizontally and vertically, respectively, through the placement of additional forms such as form 1. The elongated slots at the edges of the concrete forms may be locked to each other to form the network of forms forming the inner and outer networks of forms. While additional gated holes are illustrated on internal struts and spanners, these elongated slots may not be used for the use of such slots on all struts and spanners reduces the likelihood of an error in construction leaving a form without a slot needed to join to an adjacent form.

Such joinder of forms to form networks of forms is achieved by the use of a joining spike, whose construction and use is well known to those of ordinary skill in the art. Such joining spikes are sometimes referred to as wedge bolts. They may join two forms to each other by having one joining spike passing through the elongated slots 5 or six in adjoining forms to support i both of the forms with respect to each other, as more fully appears below.

Figure 2:
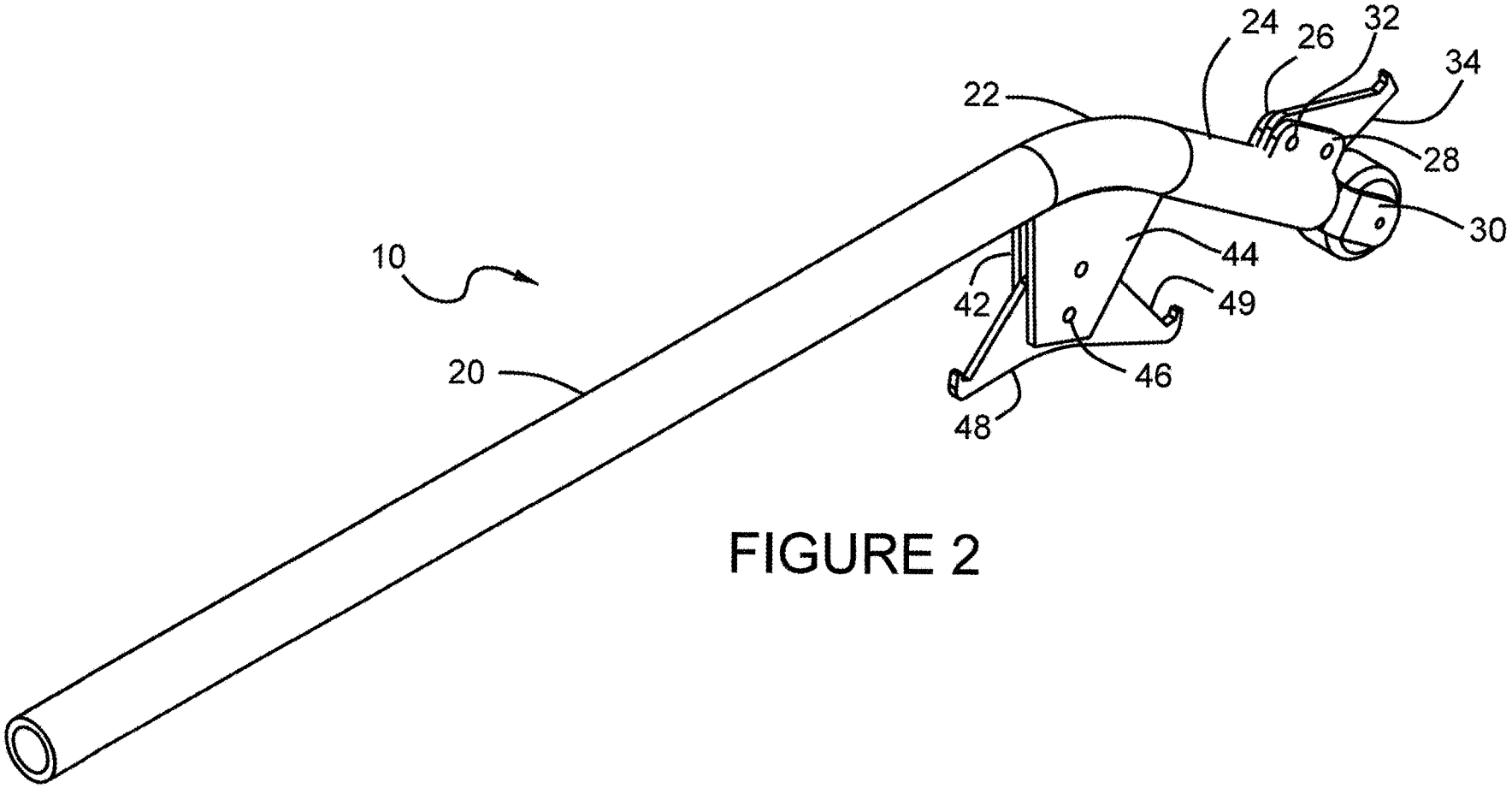
FIG. 2 is an exemplary non-limiting perspective view from above of the inventive tool for prying forms from a concrete wall.

FIGS. 2 through 7 are exemplary non-limiting diagrams illustrating the construction of the inventive tool for prying forms from a concrete wall. Referring to FIG. 2, the tool 10 comprises a part lever arm comprising a long handle 20, a curved section 22, and a short section 24, which together form a single unitary rigid member, optionally made of steel, and, optionally may be made from a single bent pipe or from a single forging or casting. Short section 24 is welded to a pair of steel brackets 26 and 28. A U-shaped wheel mount 30 is also secured to short section 24. Brackets 26 and 28 are welded to short section 24 and allow for the use of bolts 32 to affix an engagement member 34. This configuration is further demonstrated in FIGS. 5 and 7.

Curved section 22 is provided with plate brackets 42 and 44 capable of receiving bolts 46 which affix additional engagement members 48 and 49. Curved unit 22, short unit 24 as well as their components are further depicted in FIGS. 3 and 4.

Figure 3:
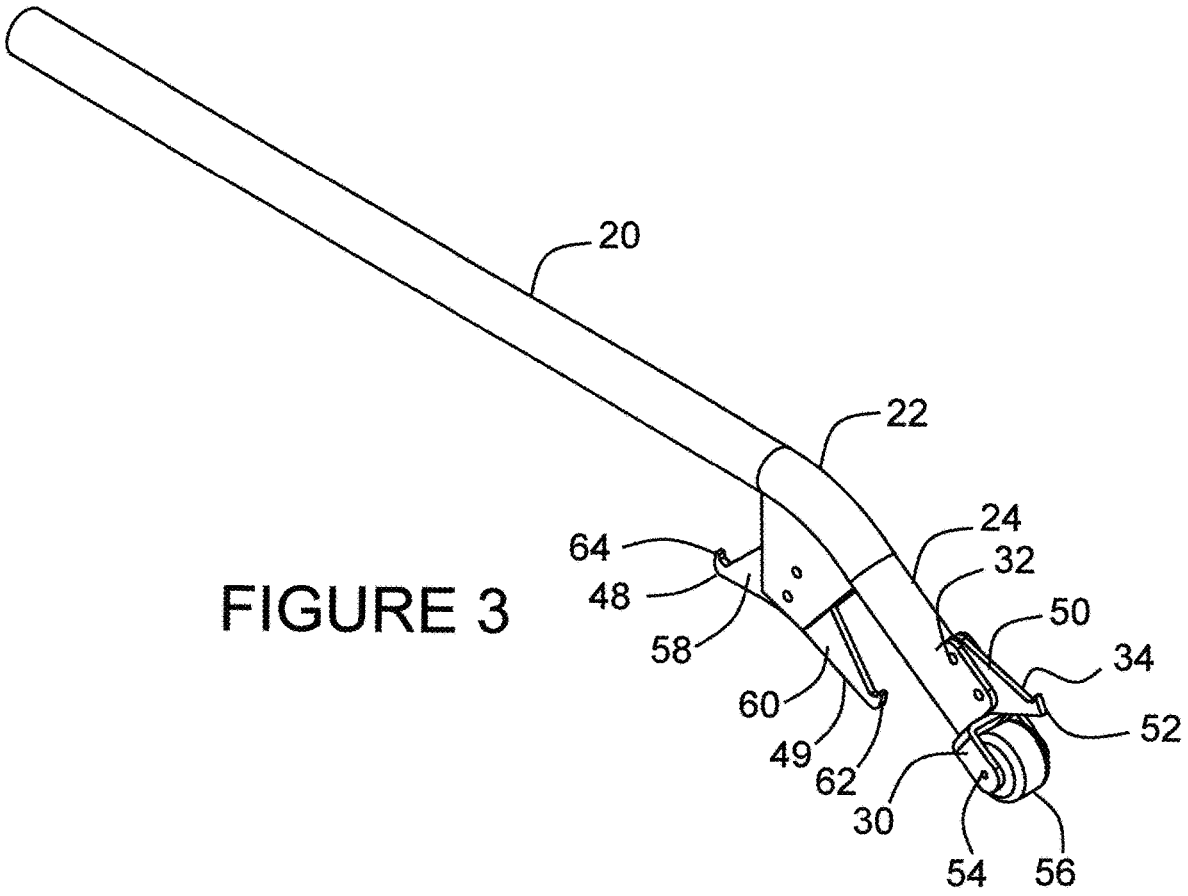
FIG. 3 is another perspective view of the tool of FIG. 2 from a different point of view.
Figure 4:
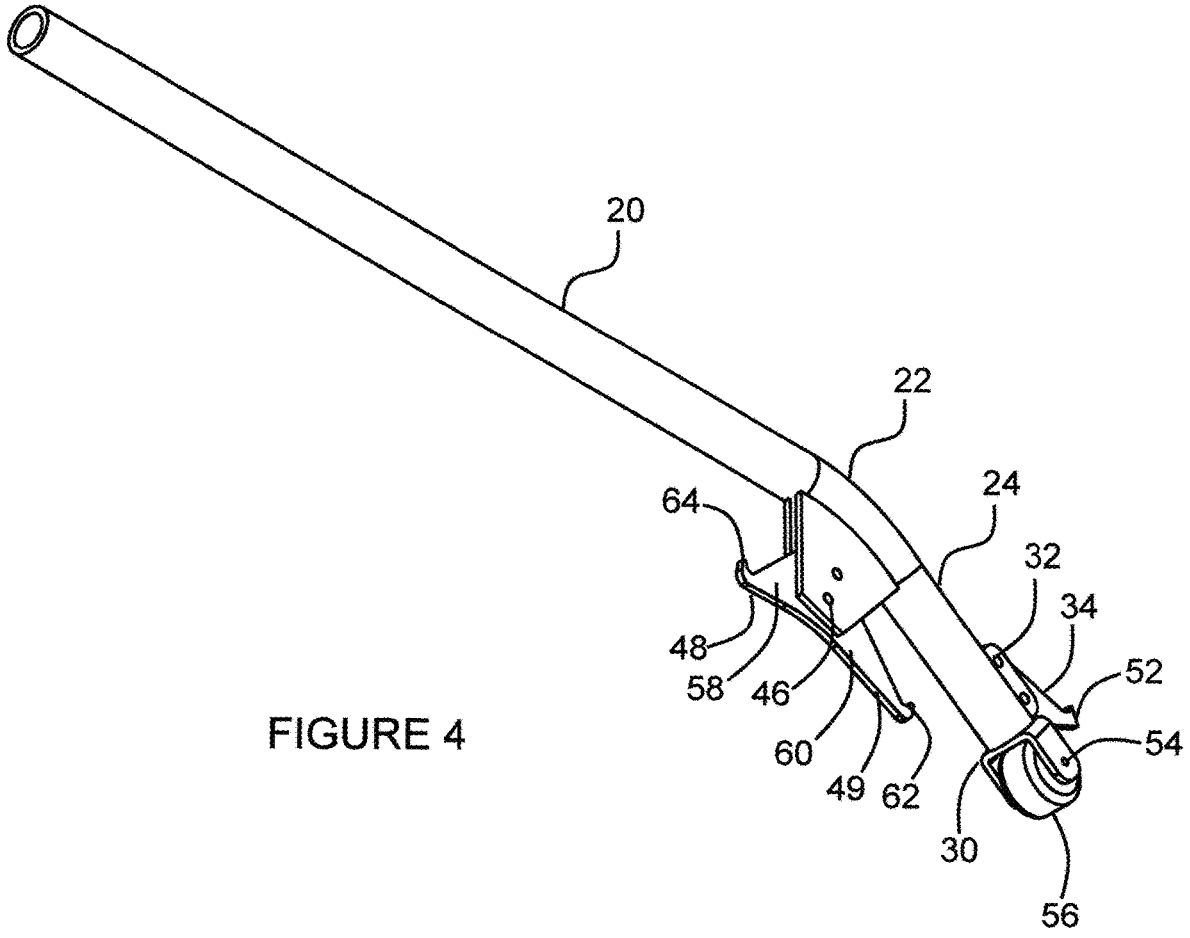
FIG. 4 is another view of the tool of FIG. 2 from the bottom.
Figure 5:
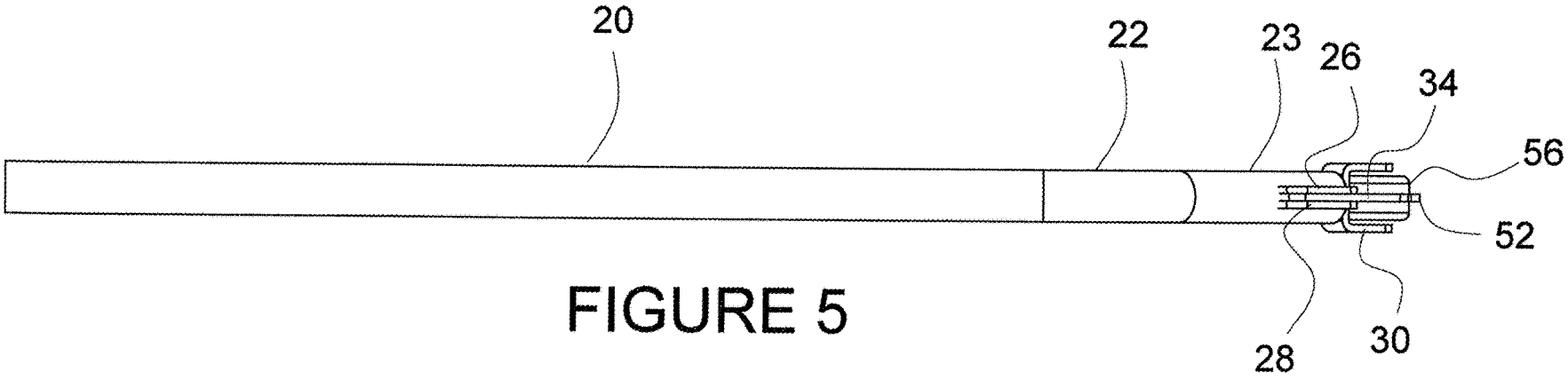
FIG. 5 is a top plan view of the tool of FIG. 2.
Figure 6:
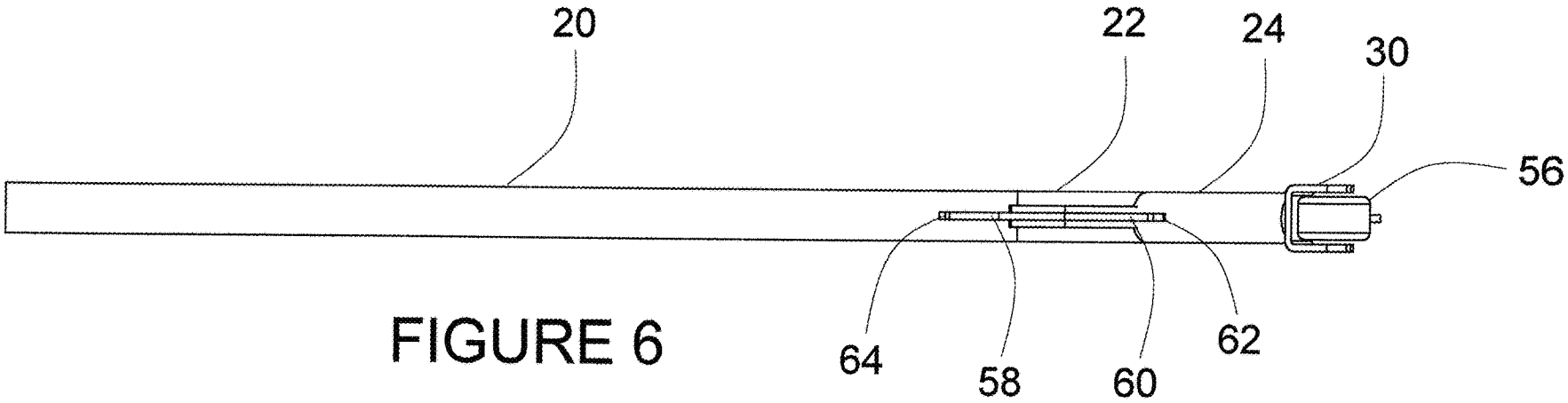
FIG. 6 is a bottom view of the tool of FIG. 2.
Figure 7:
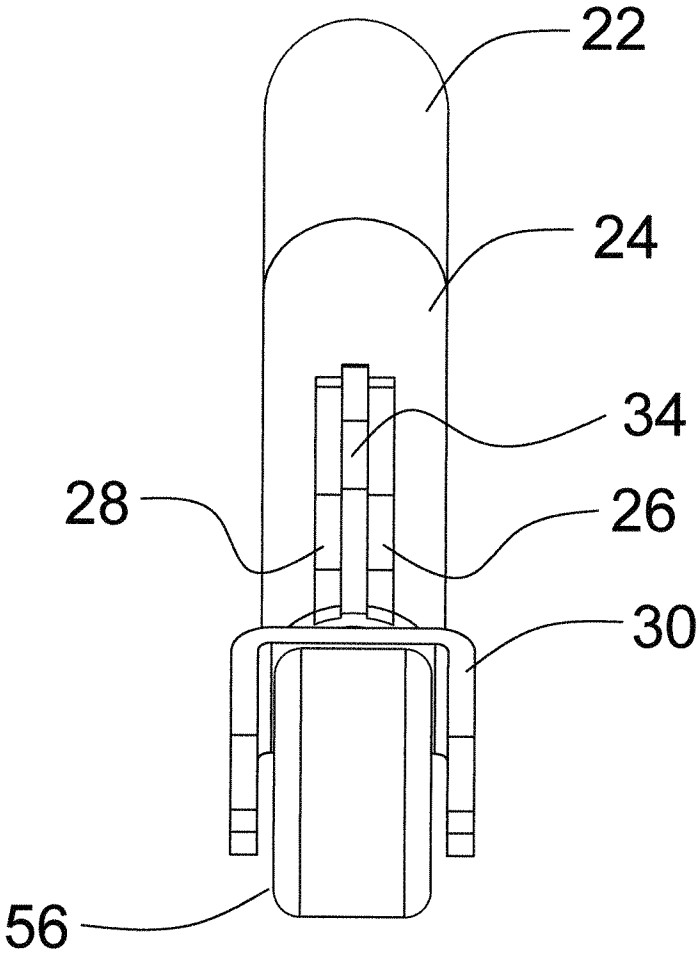
FIG. 7 is a front view of the tool of FIG. 2.

FIGS. 3 and 4 are further exemplary non-limiting diagrams of the disclosed tool viewed from varying orientations. More particularly, engagement member 34 comprises a base portion 50 that receives bolts 32 and a hook-like grasping portion 52. U-shaped wheel mount 30 is welded to short section 24 and comprises an axle 54. A wheel 56 is rotatably supported on axle 54. Brackets 42 and 44 are welded or otherwise affixed to curved unit 22. Brackets 42 and 44 support bolts 46. Bolts 46, in turn, secure hook-like engagement members 48 and 49. Hook-like engagement members 48 and 49 comprise base portions 58 and 60 (FIG. 3) as well as hook-like grasping portions 62 and 64. This configuration is further illustrated in FIG. 6.

Figure 8:
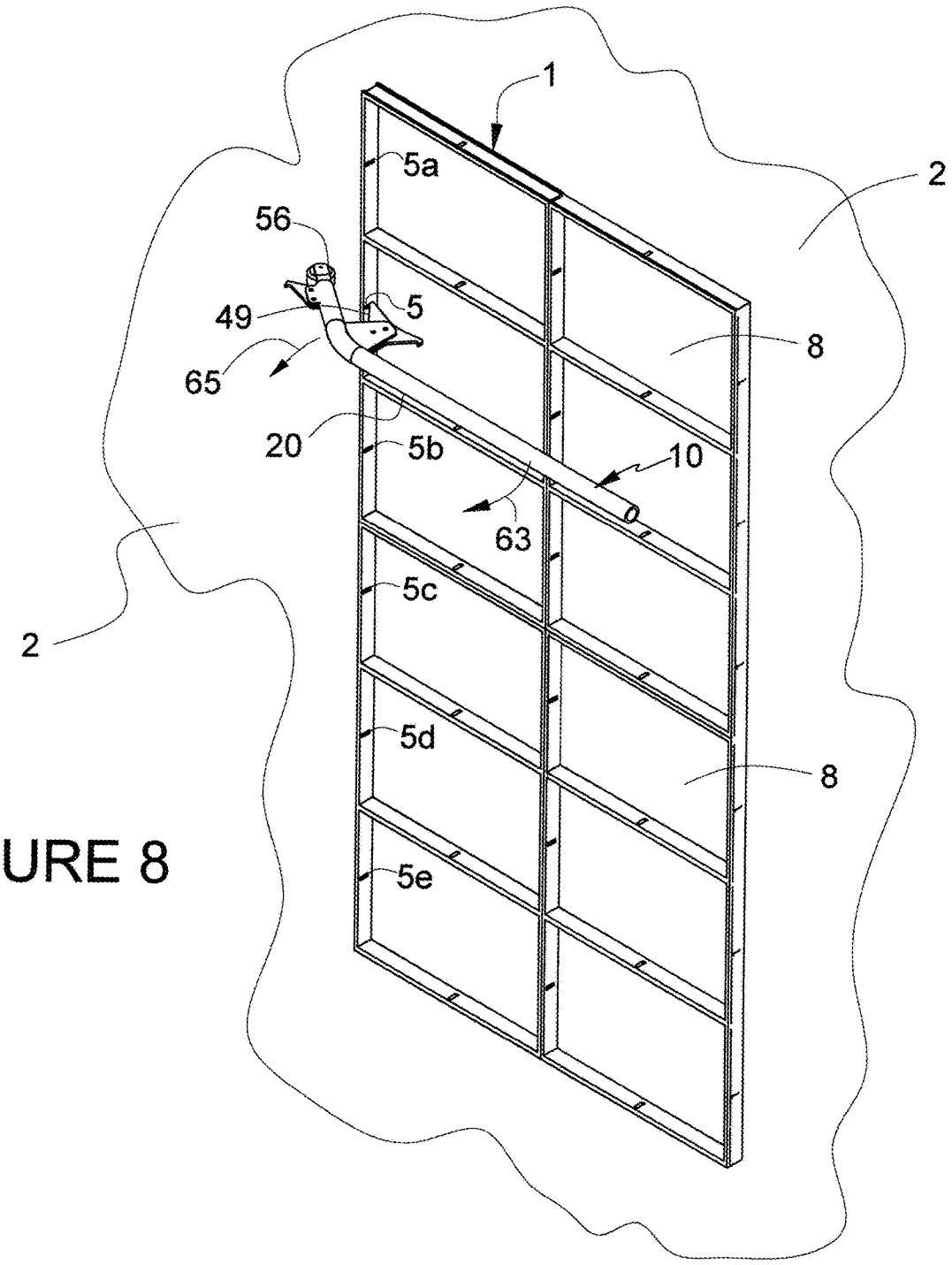
FIG. 8 is an exemplary non-limiting diagram showing the engagement of the inventive tool of FIG. 2 with a concrete form mold section during removal of a mold section from a formed and hardened wall.
Figure 9:
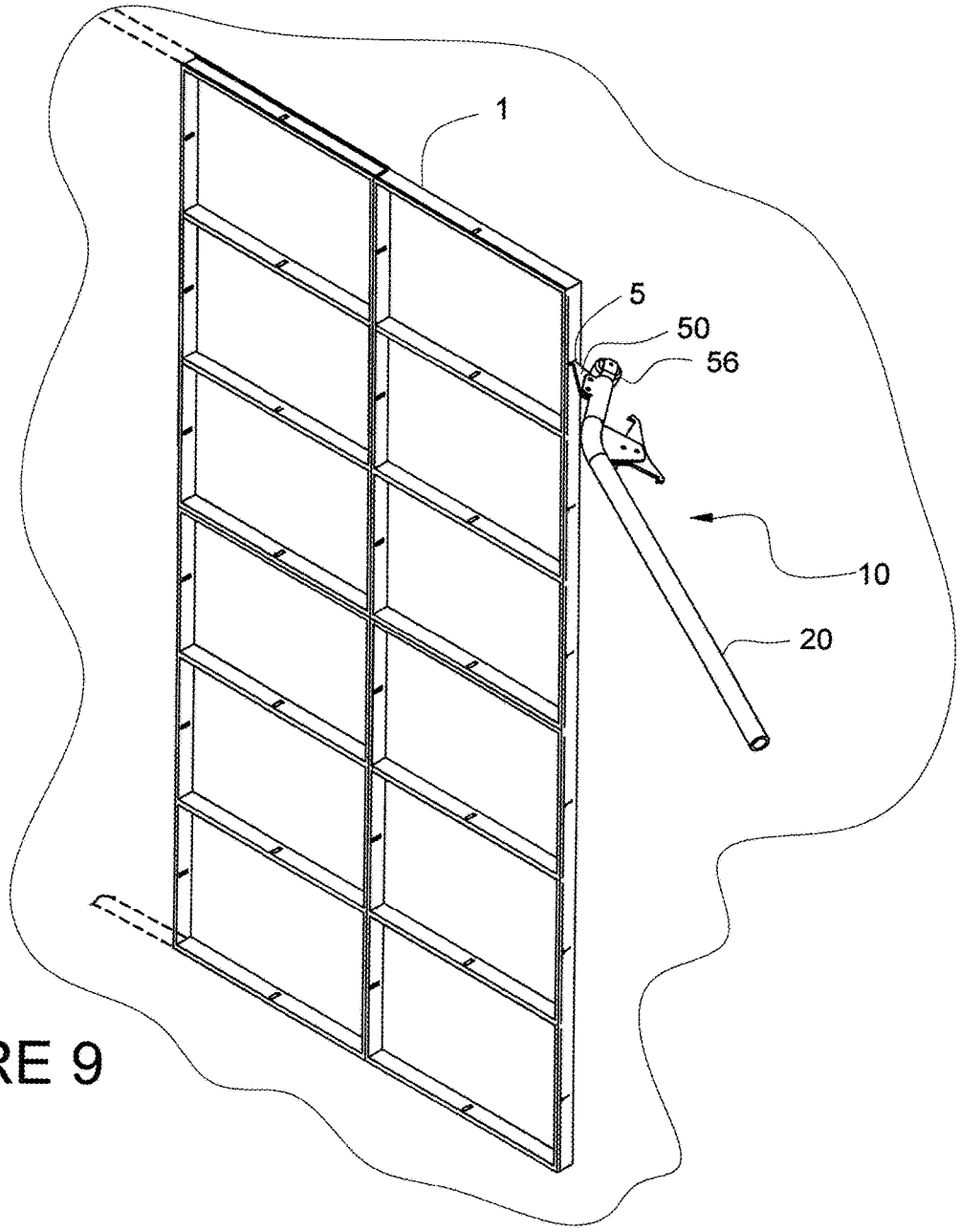
FIG. 9 illustrates an alternative configuration between the inventive tool of FIG. 2 and a mold section for removal of the mold section from a formed concrete wall.
Figure 10:
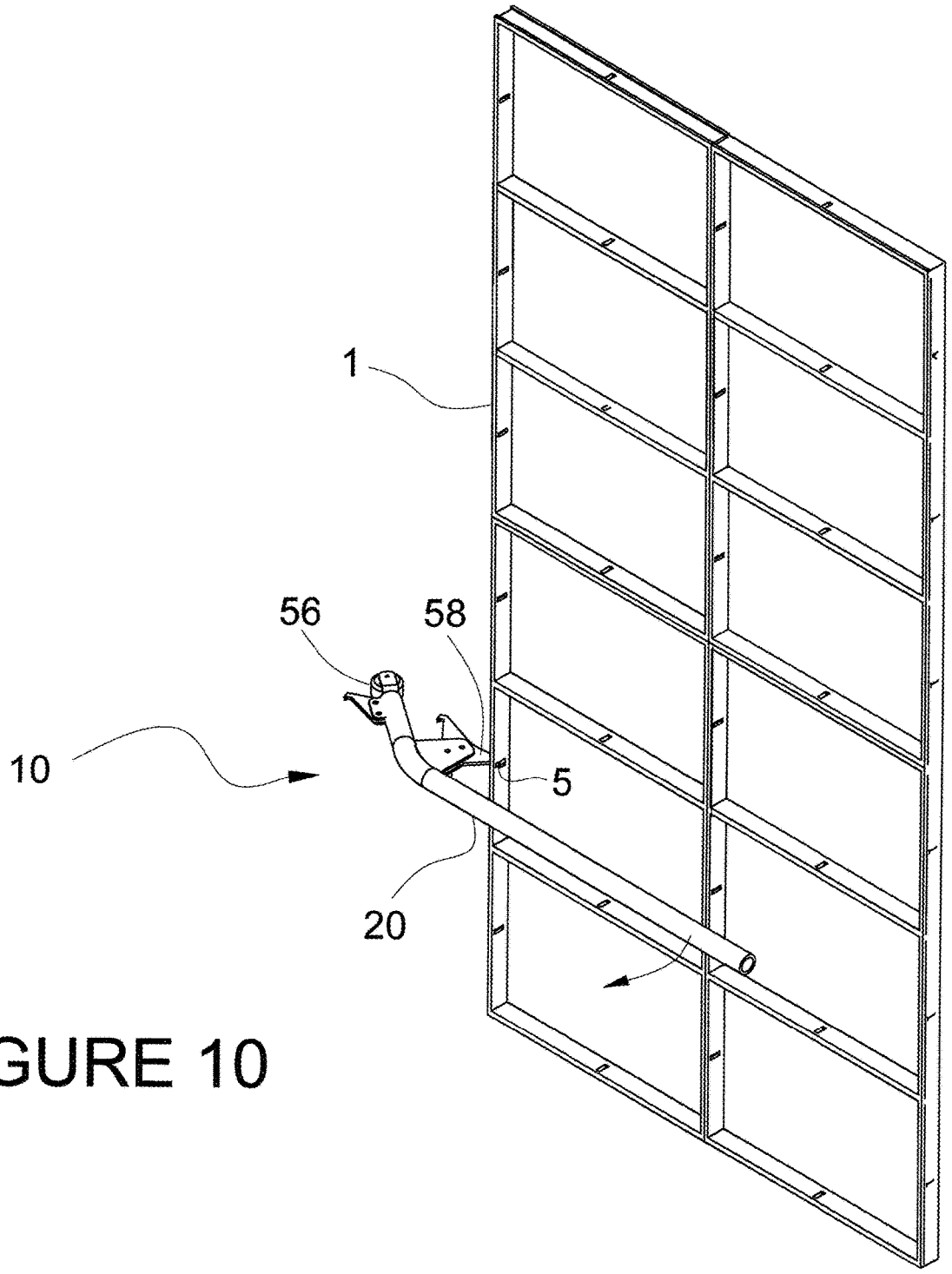
FIG. 10 illustrates a further alternative configuration for engagement of a formed wall section by the inventive tool of FIG. 2 during removal of a concrete form mold unit from a formed concrete wall.

FIGS. 8 through 10 are non-limiting exemplary diagrams of the disclosed tool engaging a standard concrete form using various engagement configurations and methods. Referring to FIG. 8 in particular, after the wedge bolts joining form 1 to other forms have been removed, tool 10 is brought into engagement with one of forms 1 in the interlocked network of concrete forms from the interior of form 1 as the first step in the process of separating form one from wall 2. Hook like engagement member 49 engages the existing elongated hole 5 in form 1 by passing through elongated hole 5. Elongated hole 5 is open because the wedge bolts securing it to the adjacent form have been removed. Long handle 20 is then moved in the direction of arrow 63. This results in advancing hook-like engagement member 49 in the direction of arrow 65, and pulling vertical strut 3, together with the rest of form 1, away from wall 2, while simultaneously causing wheel 56 to roll on wall 2. In accordance with the invention, in order to minimize damage to plywood board 8, it is contemplated that it may be necessary to achieve separation between form 1 and wall 2 by the application of small amounts of pressure to a multiplicity of elongated holes 5*a*, 5, 5*b*, 5*c*, 5*d* and 5*e*, likely preferably in that sequence in an attempt to achieve separation without damage. The sequential application of pressure to the same elongated holes may then be repeated with, optionally (depending upon the amount of separation (if any) observed during the application of pressure) increasing pressure until the desired separation is achieved.

FIG. 9 differs from FIG. 8 in that it depicts the tool 10 engaging the interlocked network of concrete forms 1 from the exterior by utilizing the engagement member 50, which engages the existing hole 5 in form 1. Similar or analogous application of pressure may be applied. Alternatively, separation may easily occur and engagement with a single elongated hole is all that may be necessary to separate form 1 from wall 2.

FIG. 10 differs from FIGS. 8 and 9 in that it depicts the tool 10 engaging the form 1 from the exterior by utilizing hook-like engagement member 58, which engages existing hole 5 in form 1. In each of FIGS. 8 through 10, wheel 56 acts as a fulcrum as it rotates and is placed against the set cement wall and long handle 20 is pulled away from wall 1, resulting in removal of the concrete form 1 from the set concrete. This is done for each of the individual forms in the network of concrete forms which acted as a mold for the concrete forming wall 2.

In accordance with the invention it is contemplated that the tool may take alternate embodiments, such as the embodiment illustrated in FIG. 11, as will be described in detail below.

Figure 12:
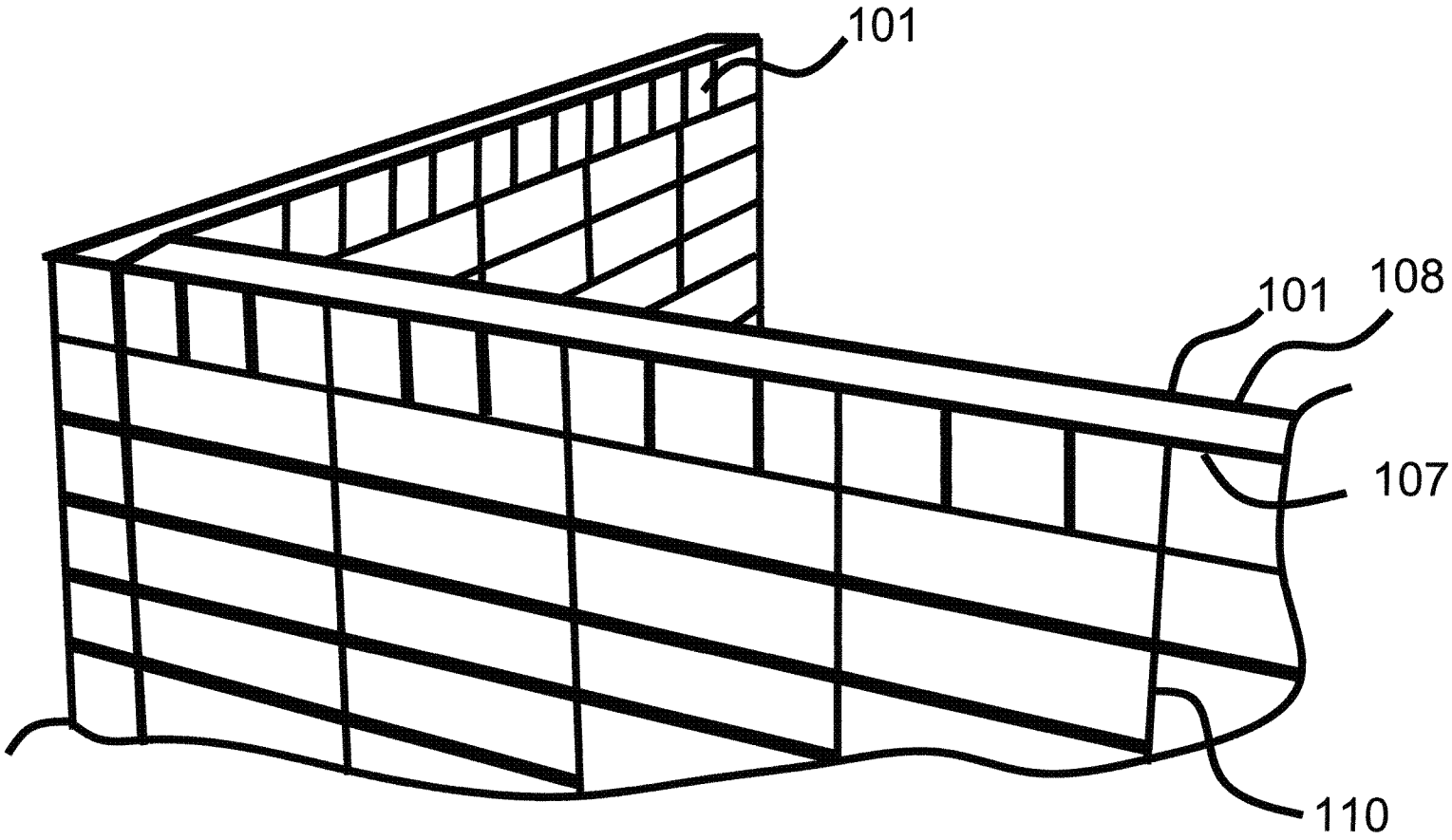
FIG. 12 is an illustration of a standard concrete form mold having an outer mold and inner mold and suitable for employment of the tool of the present invention.

To better understand the overall process of molding a wall using the inventive tool, FIG. 12 shows the construction of a typical wall using a mold formed from concrete forms. In this embodiment and in succeeding embodiments, where practical, analogous parts are given numbers which are separated by multiples of 100 from corresponding parts in earlier embodiments. The inventive concrete mold 110 is formed by a plurality of forms 101, which together form an inner mold network 108 which is made from a network of interlocked concrete forms 101, and an outer mold network 109 which is also made from a network of interlocked concrete forms 101. After form networks 108 and 109 are assembled, using wedge bolts positioned as locking spikes and joining spikes, the wall is fabricated by pouring cement in the space between the inner mold network 108 and outer mold network 109. After this, the which both removed and the individual forms 101 separated from the wall after it has hardened and cured.

Figure 13:
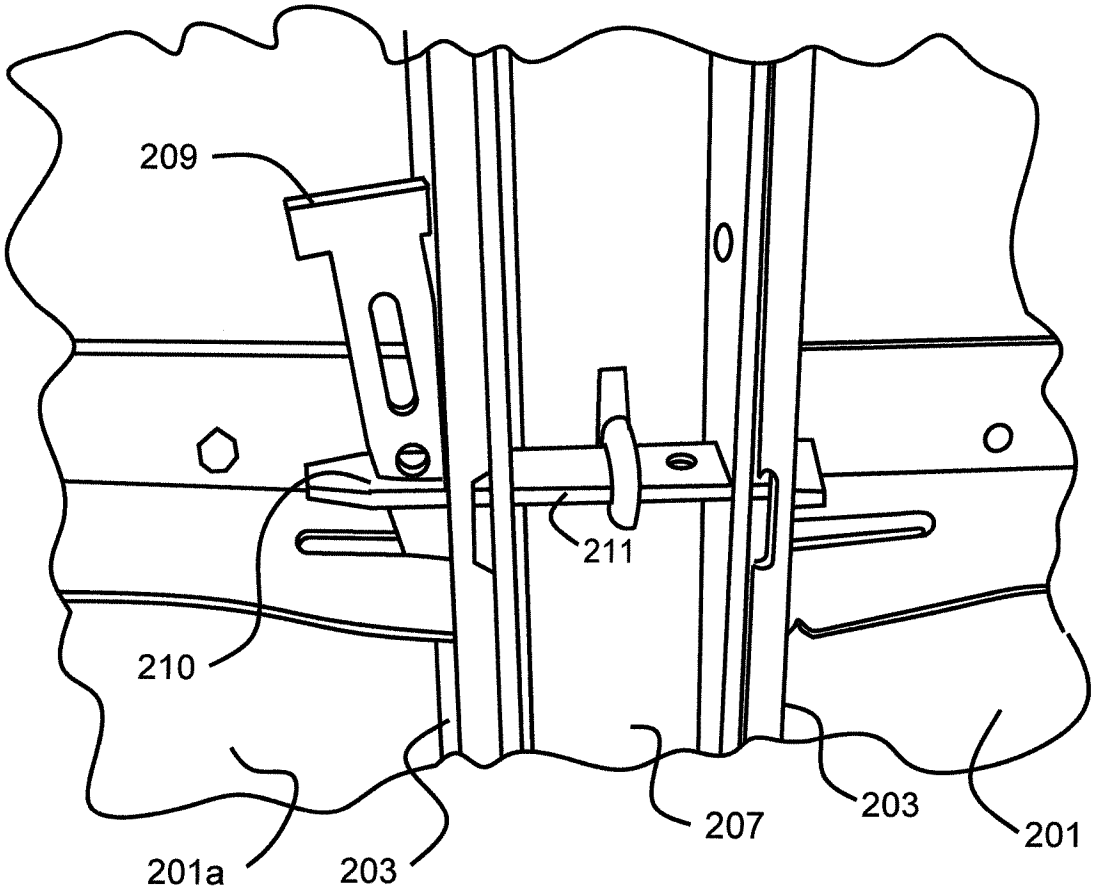
FIG. 13 is an illustration of the use of standard joining and locking spikes.

FIG. 13 illustrates an exemplary joining structure in which a form 201 is joined to a form 201*a* using a steel strengthening member 207 with a U-shaped cross-section. Strengthening member 207 is placed between forms 201 and 201*a*. A wedge bolt 208, positioned as a joining spike, passes through the vertical struts 203 in forms 201 and 201 eight. Wedge bolt 208 is locked in place by another wedge bolt 209, which is positioned as a locking spike, passing through a slot 210 in joining spike wedge bolt 211

Figure 14:
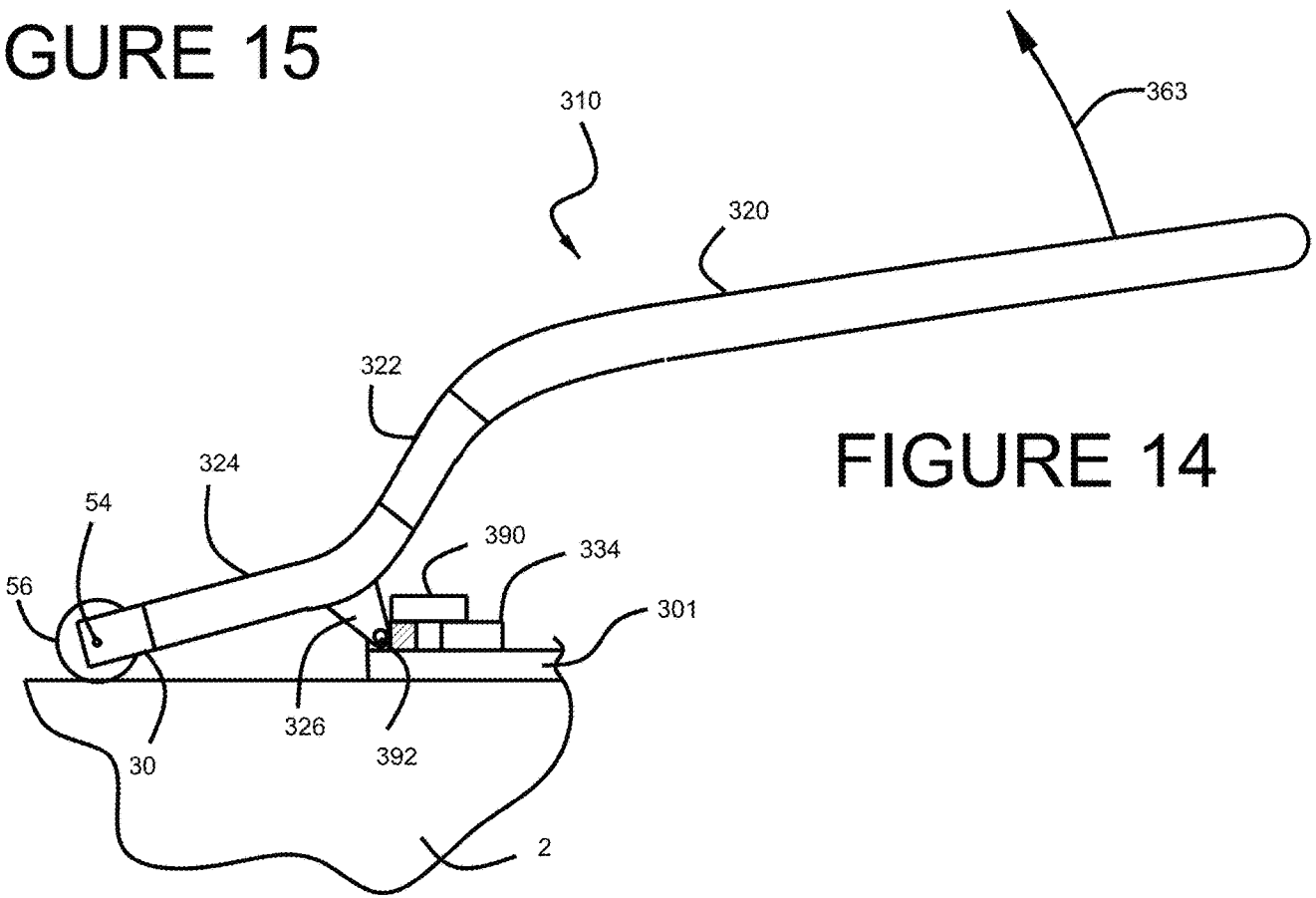
FIG. 14 is a side view illustrating an alternative embodiment of the inventive tool for prying forms (of the type including knobs meant to perform the function of engagement between different form sections) from a concrete wall adhering to the form after curing of a wall.
Figure 15:
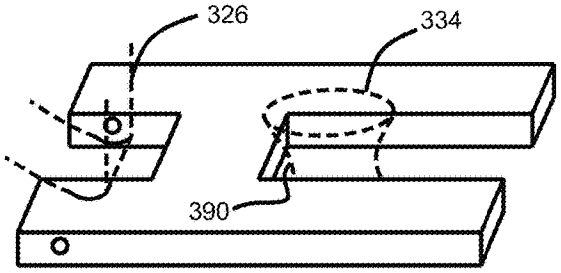
FIG. 15 illustrates the construction of the engagement member of the embodiment of FIG. 14.

FIG. 14 is an exemplary non-limiting diagram detailing an alternative embodiment of the inventive tool 310 for prying forms from a concrete wall engaging with the form. More particularly, tool 310 is designed to engage a knob 390 which is a part of a form 301 via an engagement member 334. Form 301 is in contact with the hardened concrete 2. In this alternative embodiment, engagement member 334 is pivotally mounted to the short portion 324 of the lever arm, comprising elongated handle 320 via a bracket 326. A plate bracket 326 is welded to short portion 324. Bracket 326 is, in turn, secured by an axle 392 to engagement member 334. Accordingly, engagement member 334 is capable of pivoting with respect to short portion 324. The construction of engagement member 334 is illustrated with relation to knob 334 and plate bracket 326 in FIG. 15.

Figure 16:
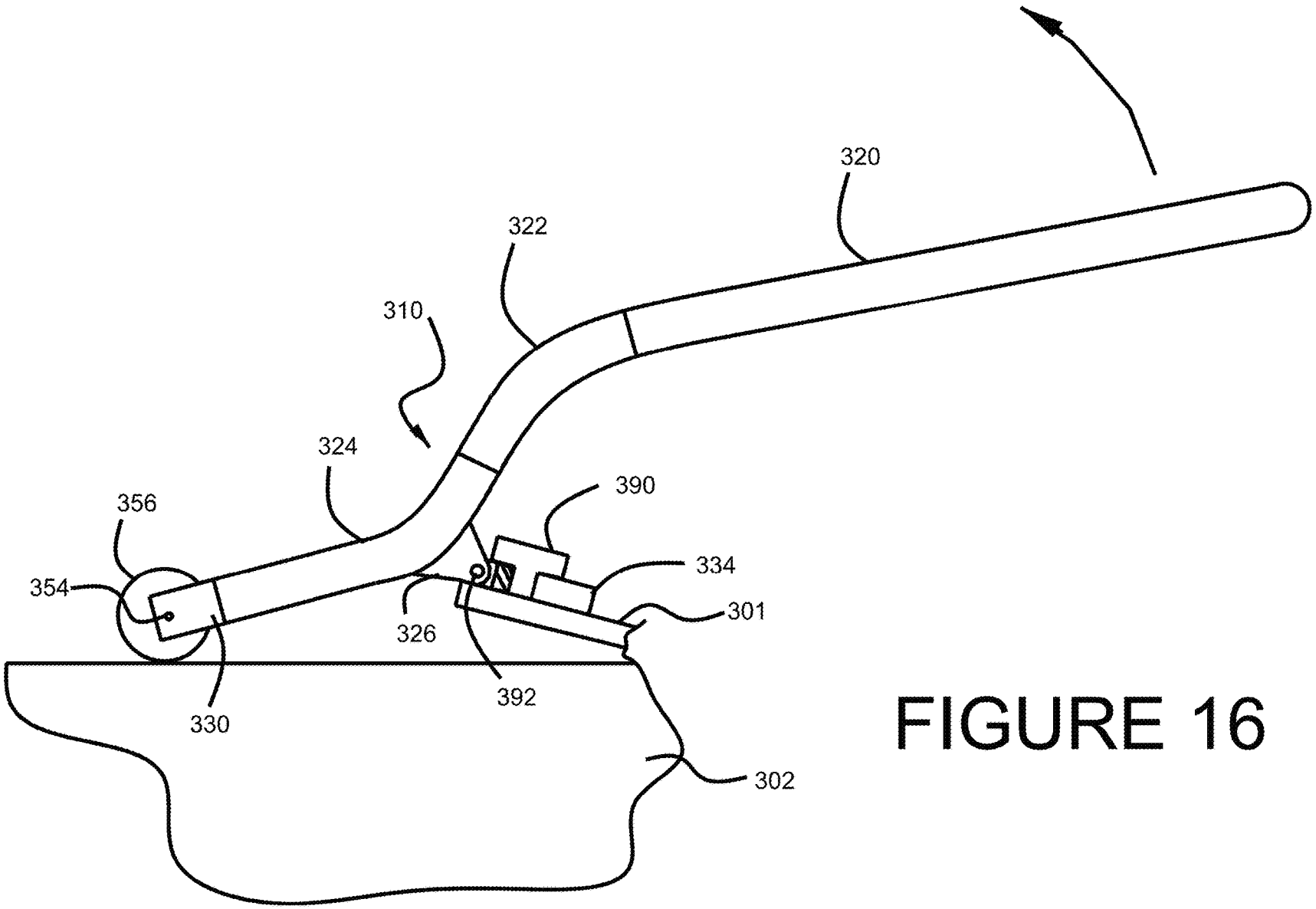
FIG. 16 illustrates the tool of FIG. 14 prying a form from a concrete wall.

FIG. 16 is an exemplary non-limiting diagram illustrating use of inventive tool 310 for prying forms from a concrete wall 302 to separate them from wall 302 by applying a force to form 301 with force being applied to knob 390 to remove form 301 from concrete wall 302. Such separation is achieved by moving handle 320 in the direction of arrow 363. Referring to FIG. 16, it differs from FIG. 14 in that force has been applied to the long unit 320 of the lever arm in order to remove the form 301 from the hardened concrete 2. Engagement member 334 pivots on axle 392 to apply of pulling force to the knob 390 lifting the form 301 from concrete 302, but without applying the twisting force to knob 390 by trying to increase the distance between the top of the top 390 and form 301. Smooth operation is facilitated by rotational wheel 356.

Figure 17:
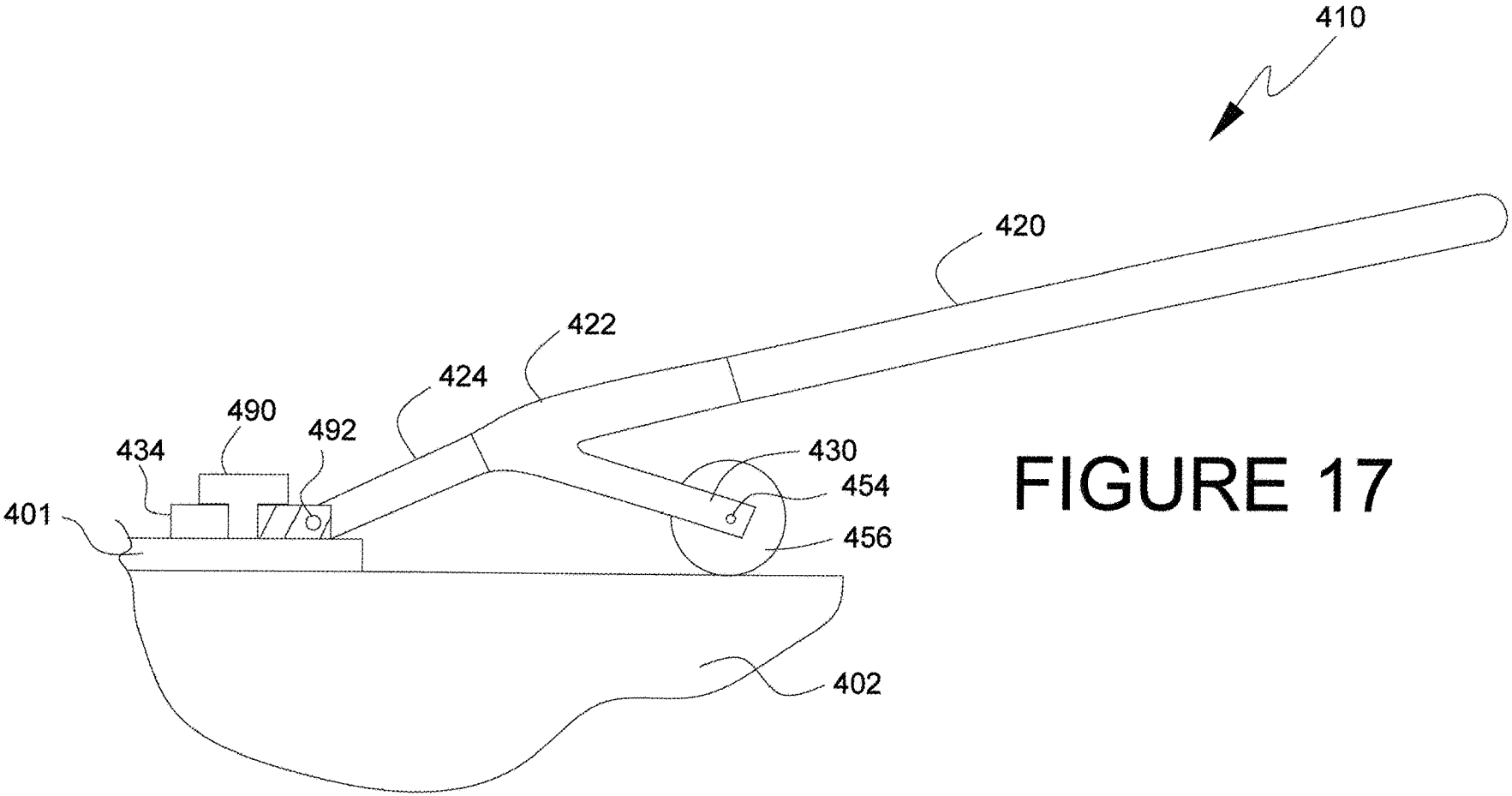
FIG. 17 is an exemplary non-limiting diagram detailing a further alternative embodiment of the inventive tool for prying forms from a concrete wall engaging with the form.

FIG. 17 is an exemplary non-limiting diagram detailing a further alternative embodiment of tool 410 for prying forms from a concrete wall engaging with the form. Referring to FIG. 17, it differs from FIG. 14 in orientation of the engagement member 434 and the wheel mount 430. In the alternative embodiment depicted in FIG. 17, an engaging member 434 is affixed to a short unit 424 of the lever arm and the wheel unit 430 is affixed to the curved unit 422 of the lever arm. This alternative orientation allows for more diverse engagement of knob 490 of the form 401 from wall 402. Smooth operation is facilitated by rotation of wheel 456.

Figure 18:
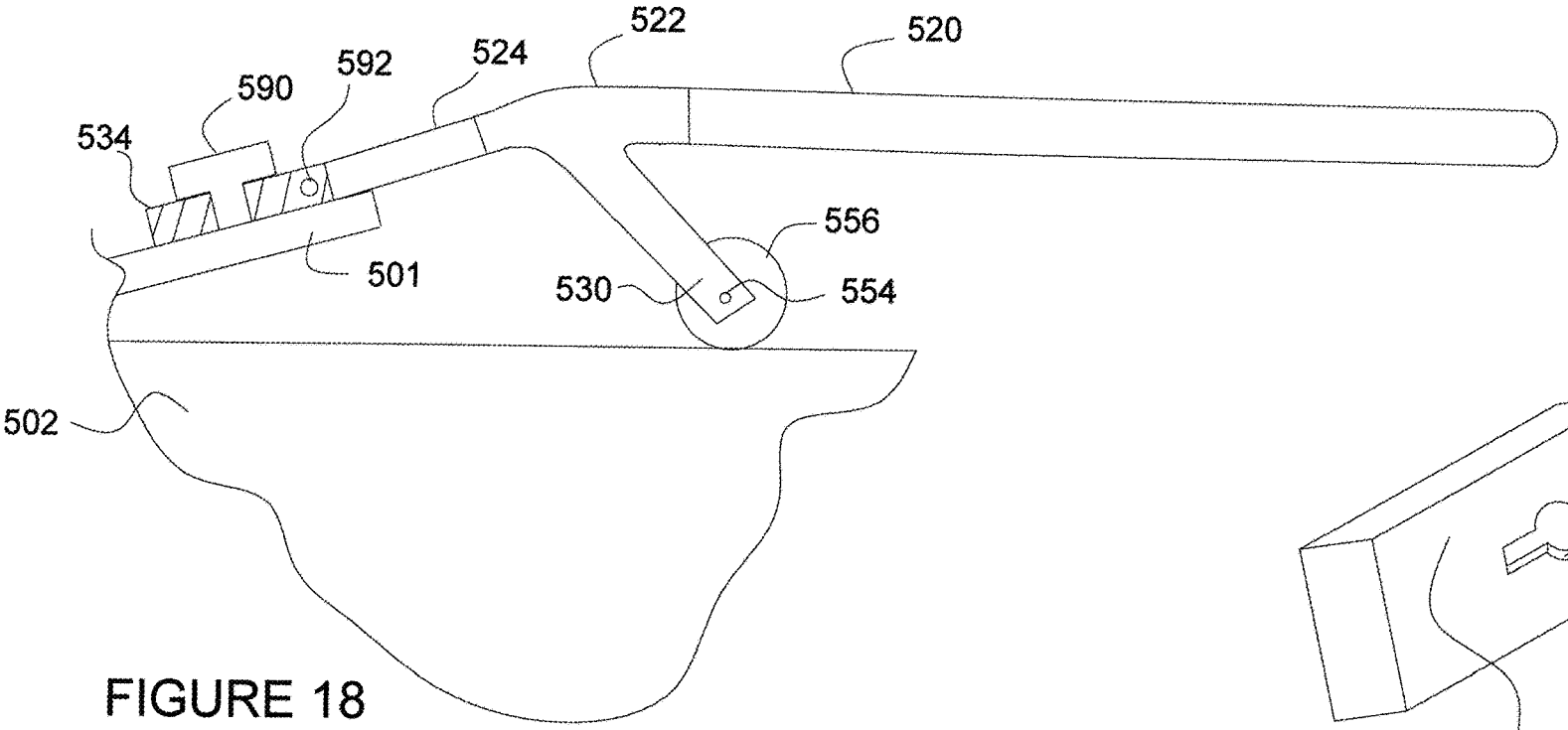
FIG. 18 is an exemplary non-limiting diagram detailing an alternative embodiment of the inventive tool for prying forms from a concrete wall engaging with the form with force being applied to remove the form from the concrete wall.

FIG. 18 is an exemplary non-limiting diagram detailing an alternative embodiment of the inventive tool in the process of prying a form 501 from a concrete wall 502 by engaging with the form with force being applied to remove the form from the concrete wall. Referring to FIG. 18, it differs from FIG. 17 in that force has been applied to the handle 520 of the lever arm in order to remove the form 501 from the hardened concrete wall 502. Engagement member 534 pivots at axle 592 to apply force to knob 590 lifting the form 501 from concrete wall 502.

Figure 19:
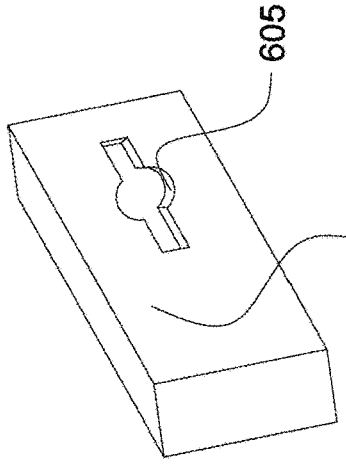
FIG. 19 is a non-limiting photographic image of a standard doka concrete form unit joining insertion.

FIG. 19 is a non-limiting illustration of a standard doka concrete form unit joining insertion. In this system, struts 603 have a double keyhole shaped elongated hole 605. The tool of the present invention may be provided with a hook-like engaging member configured to match hole 605. As will be apparent to those of ordinary skill in the art, the hooks and/or other engaging mechanisms in the various illustrated embodiments may be configured to conform to various mold systems, thus providing a tool having a pivot point on a wheel as a base for the application of force to the concrete form.

It is also contemplated that the inventive tool may be fabricated without a wheel, using a solid member instead.

Figure 11:
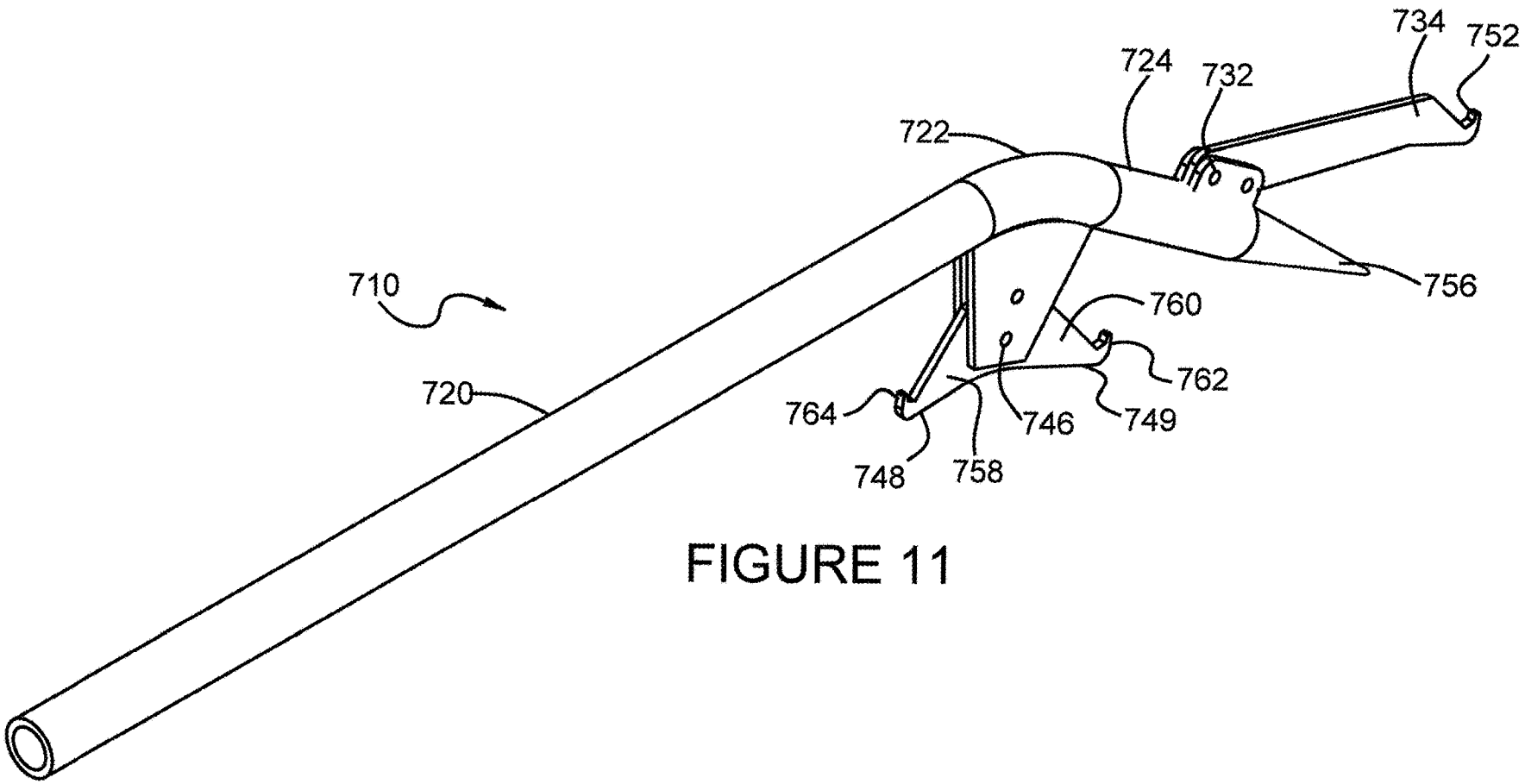
FIG. 11 is a perspective view of an alternative embodiment of the inventive tool.

More particularly, as illustrated in FIG. 11, an alternative embodiment of the tool 710 may include a stud member, for example, a conical stud 756, in place of a wheel. Join use the tool, the tip of stud 756 would be brought in contact with a support surface and the tool pivoted about stud 756 in the manner of use of the other embodiments of the invention. More particularly, stud 756 is used as a pivot point in the manner that the wheel of the other embodiments is used as a pivot point.

The concrete form snipping tool of the present disclosure described herein may be utilized in the following non-limiting types of applications and uses: engaging a concrete form mold unit via the engagement member of the tool to achieve concrete form separation, and engaging a concrete form mold unit for separation of the mold unit from a concrete wall following the pouring and hardening of a concrete wall. The advantages of the disclosed concrete form snipping tool include the following: the capability of use with existing concrete form molds; capability of use by a single individual; and concrete form extraction which does not damage the plywood forms which are to be re-used in further concrete pouring operations.

While illustrative embodiments of the invention have been described, it is noted that various modifications will be apparent to those of ordinary skill in the art in view of the above description and drawings. Such modifications are within the scope of the invention which is limited and defined only by the following claims.

The invention claimed is:

1. A tool for removing, from a set concrete wall, a concrete form of a type having an engagable structure comprising:

(a) a lever arm having two ends, comprising a form engagement portion positioned near one end of said lever arm and a grasping portion to be grasped by a user during use of the tool, said grasping portion positioned at the other end of said lever arm;

(b) at least one engagement member, said engagement member being configured to mate with said engagable structure on said concrete form, said engagement member comprising an engagement member mounting portion and an engagement end, said engagement member being secured to said form engagement portion of said lever arm at the engagement member mounting portion of said engagement member; and (c) a pivoting member mounted on said lever arm proximate said engagement portion, said pivoting member defining a pivot point around which said lever arm may rotate, said engagement member extending, in the direction from said engagement member mounting portion to said engagement end, toward said pivot point, said pivot point being positioned with respect to said engagement member whereby rotation of the lever arm about said pivot point will apply force through said engagement member to said engagable structure tending to move said engagable structure and said concrete form away from said set concrete wall when the engagement portion of said lever arm is moved with respect to said set concrete wall and said engagement member is in engagement with said engagable structure.

2. The tool of claim 1, wherein said pivoting member comprises a pivot surface defined on a stud that is rigidly secured to said lever arm.

3. A tool as in claim 1, wherein said pivoting member comprises a wheel rotatably mounted near the engagement portion of the lever arm.

4. A tool as in claim 3, wherein the engagement member comprises a stud extending from said engagement portion, said stud having a base portion and an engagement end, said base portion of said stud being secured to said engagement portion of said engagement member and extending toward said pivot point, and said engagement end extending toward said grasping portion and being configured to engage a hole or slot in said concrete form, said hole or slot forming said engagable structure.

5. The tool of claim 3, further comprising a second engagement member secured to said lever arm at a position different from the position at which said engagement member is mounted, and the orientation of the engagement member with respect to the lever arm is different from the orientation of the second engagement member with respect to the lever arm.

6. A tool as in claim 3, wherein the engagement member is angularly oriented with respect to the lever arm.

7. A tool as in claim 6, wherein said angle is between 0° and 40°.

8. A tool as in claim 3, wherein the engagement member is a hooking member.

9. A tool as in claim 3, wherein the engagement member comprises a U-shaped engagement member, configured and dimensioned to slide under a knob on the concrete form, said U-shaped engagement member being rotatably mounted on said engagement portion of said lever arm.

10. A tool as in claim 9, wherein the engagement portion of said lever arm is smaller than one-third the length of the remaining portion of the lever arm.

11. The tool of claim 10, further comprising a second engagement member secured to said lever arm at a position different from the position at which said engagement member is mounted, said second engagement member comprising a stud extending from said engagement portion, said stud having a base portion and an engagement end, said base portion of said stud being secured to said engagement portion of said engagement member, and said engagement end being configured to engage a hole or slot in said concrete form.

12. A tool as in claim 11, wherein the second engagement member is a hooking member.

13. A tool as in claim 1, wherein said lever arm comprises a curved portion having a convex side and a concave side configured to support said grasping portion at an angle to said form engagement portion and further comprising an additional engagement member, i) said at least one engagement member being positioned radially outward from the convex side of the curved portion and ii) said additional engagement member being positioned radially inward from the concave side of the curved section.

14. A tool as in claim 1, wherein the at least one engagement member is positioned between the grasping portion of said lever arm and the pivot point of the pivoting member.

15. A tool as in claim 14, wherein the engagement portion of said lever arm is no larger than half the length of the remaining portion of the lever arm.

16. The tool of claim 1, wherein multiple engagement members are provided at multiple orientations with respect to the lever arm.

17. The tool of claim 1, further comprising a second engagement member secured to said lever arm at a position different from the position at which said at least one engagement member is mounted, and the orientation of the one engagement member with respect to the lever arm is different from the orientation of the second engagement member with respect to the lever arm.

18. Apparatus comprising a tool as in claim 1 and a plurality of concrete forms, said concrete forms comprising i) a substantially flat molding member, said molding member defining a molding surface and a rear support surface, and ii) a plurality of vertical members, said vertical members being secured to said rear support surface, said vertical members defining holes, said holes forming said engagable structure, and said holes being configured and dimensioned to be engaged by said engagement member.

19. Apparatus as in claim 18, wherein said holes are positioned, when molding members are placed adjacent to each other, to result in alignment of holes on one vertical member of one molding member with holes on a vertical member on an adjacent molding member, the aligned holes forming a locking channel, and further comprising:

(d) at least two pin members for joining adjacent molding members, and configured to simultaneously pass through adjacent holes on two adjacent molding members, each of said pin members having a head at one end and a locking hole on the other and; and (e) at least two locking members configured and dimensioned to pass through the locking hole on a respective pin member.

20. Apparatus as in claim 19, wherein the locking members have the same configuration as said pin members, whereby the locking members and the pin members may be used interchangeably to perform joining and latching functions.

21. A method for removing, from a set concrete wall, a concrete form of a type having an engagable structure comprising:

(a) engaging an engagement member, secured to an engagement portion at an end of a lever arm, with said engagable structure on said form, (b) moving the lever arm with respect to the set concrete wall, by applying force to a grasping portion of said lever arm on the opposite end of the lever arm from the engagement portion of the lever arm; and (c) pivoting said lever arm about a pivoting member mounted proximate to a curved section of said lever arm which is proximate to said engagement portion, whereby said engagement member applies force to said engagable structure tending to move said engagable structure away from said set concrete wall, said engagement member being engaged by placing said pivoting member and engagement member on opposite sides of said engagable structure, said engagement member being advanced in a direction toward said pivoting member to engage said engagable structure.

22. A tool for removing, from a set concrete wall, a concrete form of a type having an engagable structure comprising:

(a) a lever arm having two ends, comprising a form engagement portion positioned near one end of said lever arm and a grasping portion to be grasped by a user during use of the tool, said grasping portion positioned at the other end of said lever arm;

(b) a first engagement member, said first engagement member being configured to mate with said engagable structure on said concrete form, said first engagement member comprising an engagement member mounting portion and an engagement end, said first engagement member being secured to said form engagement portion of said lever arm at the engagement member mounting portion of said first engagement member;

(c) a pivoting member mounted on said lever arm proximate said first engagement portion, said pivoting member defining a pivot point around which said lever arm may rotate, said pivot point being positioned with respect to said first engagement member whereby rotation of the lever arm about said pivot point will apply force through said first engagement member to said engagable structure tending to move said engagable structure and said concrete form away from said set concrete wall when the engagement portion of said lever arm is moved with respect to said set concrete wall and said first engagement member is in engagement with said engagable structure, said first engagement member extending, in the direction from said first engagement member mounting portion to said engagement end, toward said pivot point; and (d) a second engagement member secured to said lever arm at a position different from the position at which said first engagement member is mounted, the orientation of the first engagement member with respect to the lever arm being different from the orientation of the second engagement member with respect to the lever arm.

* * * * *